US007757760B2

(12) United States Patent
Sherwood et al.

(10) Patent No.: US 7,757,760 B2
(45) **Date of Patent: *Jul. 20, 2010**

(54) SYSTEM AND METHOD FOR REAL-TIME MANAGEMENT OF FORMATION FLUID SAMPLING WITH A GUARDED PROBE

(75) Inventors: John D. Sherwood, Cambridge (GB); Oliver C. Mullins, Ridgefield, CT (US)

(73) Assignee: Schlumberger Technology Corporation, Sugar Land, TX (US)

( * ) Notice: Subject to any disclaimer, the term of this patent is extended or adjusted under 35 U.S.C. 154(b) by 154 days.

This patent is subject to a terminal disclaimer.

(21) Appl. No.: 11/534,472

(22) Filed: Sep. 22, 2006

(65) Prior Publication Data

US 2008/0125973 A1 May 29, 2008

(51) Int. Cl.
*E21B 47/00* (2006.01)
*E21B 49/08* (2006.01)
*E21B 49/10* (2006.01)

(52) U.S. Cl. ..... 166/264; 166/100; 166/166

(58) Field of Classification Search ..... 166/264, 166/100, 166; 175/152.24, 152.28; 703/10
See application file for complete search history.

(56) References Cited

U.S. PATENT DOCUMENTS

| | | | | |
|---|---|---|---|---|
| 3,611,799 | A | 10/1971 | Davis | |
| 4,416,152 | A | 11/1983 | Wilson | |
| 4,860,581 | A | 8/1989 | Zimmerman et al. | |
| 4,936,139 | A | 6/1990 | Zimmerman et al. | |
| 6,178,815 | B1 * | 1/2001 | Felling et al. | 73/152.19 |
| 6,223,822 | B1 | 5/2001 | Jones | |
| 6,230,557 | B1 * | 5/2001 | Ciglenec et al. | 73/152.01 |
| 6,274,865 | B1 | 8/2001 | Schroer et al. | |
| 6,301,959 | B1 * | 10/2001 | Hrametz et al. | 73/152.23 |
| 6,350,986 | B1 | 2/2002 | Mullins et al. | |
| 6,388,251 | B1 * | 5/2002 | Papanyan | 250/269.1 |
| 6,585,045 | B2 * | 7/2003 | Lee et al. | 166/252.5 |
| 6,609,568 | B2 | 8/2003 | Krueger et al. | |
| 6,719,049 | B2 * | 4/2004 | Sherwood et al. | 166/264 |
| 6,799,117 | B1 * | 9/2004 | Proett et al. | 702/12 |
| 7,251,565 | B2 * | 7/2007 | Storm et al. | 702/6 |

(Continued)

FOREIGN PATENT DOCUMENTS

GB 2418938 A 4/2006

(Continued)

OTHER PUBLICATIONS

Hammond One- and two-phase flow during fluid sampling by a wireline tool Transport in porous media, vol. 6, 1991, pp. 299-330.

*Primary Examiner*—Giovanna C Wright
*Assistant Examiner*—Cathleen R Hutchins
(74) *Attorney, Agent, or Firm*—Dave R. Hofman

(57) ABSTRACT

Embodiments of the present invention relate to systems and methods for real-time management of formation fluid sampling down a wellbore using a guarded probe. More specifically, but not by way of limitation, embodiments of the present invention provide for management of downhole fluid sampling by sensing properties of fluids collected by a downhole-fluid-sampling-device, modeling the fluid sampling process from these sensed properties and using the modeling of the fluid sampling process to manage in real-time the fluid sampling process.

2 Claims, 9 Drawing Sheets

U.S. PATENT DOCUMENTS

| | | | | |
|---|---|---|---|---|
| 7,347,262 | B2 * | 3/2008 | Tarvin et al. | 166/264 |
| 2003/0217845 | A1 | 11/2003 | Sherwood et al. | |
| 2004/0000433 | A1 * | 1/2004 | Hill et al. | 175/59 |
| 2004/0104341 | A1 | 6/2004 | Betancourt et al. | |
| 2004/0260497 | A1 * | 12/2004 | DiFoggio et al. | 702/98 |
| 2005/0165554 | A1 | 7/2005 | Betancourt et al. | |
| 2005/0246151 | A1 * | 11/2005 | DiFoggio | 703/10 |
| 2005/0257611 | A1 | 11/2005 | Fogal et al. | |
| 2006/0000603 | A1 * | 1/2006 | Zazovsky et al. | 166/244.1 |
| 2006/0042793 | A1 * | 3/2006 | Del Campo et al. | 166/264 |
| 2006/0117842 | A1 * | 6/2006 | Ramakrishnan | 73/152.55 |
| 2006/0129365 | A1 * | 6/2006 | Hammond | 703/10 |
| 2006/0155474 | A1 * | 7/2006 | Venkataramanan et al. | 702/13 |
| 2007/0119244 | A1 * | 5/2007 | Goodwin et al. | 73/152.28 |
| 2008/0073078 | A1 | 3/2008 | Sherwood | |

FOREIGN PATENT DOCUMENTS

| | | | |
|---|---|---|---|
| GB | 2442110 | A | 3/2008 |
| RU | 2183269 | C2 | 6/2002 |
| WO | 96/30628 | A1 | 10/1996 |
| WO | 2004099552 | A2 | 11/2004 |
| WO | WO 2005/065277 | A2 | 7/2005 |
| WO | WO 2005/065277 | A3 | 7/2005 |

* cited by examiner

SYSTEM AND METHOD FOR REAL-TIME MANAGEMENT OF FORMATION FLUID SAMPLING WITH A GUARDED PROBE

CROSS-REFERENCE TO RELATED APPLICATIONS

This application is related to U.S. application Ser. No. 11/534,415, filed on a date even herewith by J. D. Sherwood and entitled "System and Method for Operational Management of a Guarded Probe for Formation Fluid Sampling", the disclosure of which is incorporated herein by reference for all purposes.

BACKGROUND OF THE INVENTION

Wellbores may be drilled into earth formations to provide for location and production of various types of hydrocarbons. To form a wellbore, a downhole drilling tool with an attached bit at one end is advanced into the earth formation. As the drilling tool is advanced, a drilling mud or drilling fluid is pumped into the drilling tool and out the through the drill bit to provide for cooling of the drilling tool and carrying away of cuttings made by the interaction of the drill bit with the earth formation. In the drilling process, after interacting with the drilling tool, the drilling mud/fluid flows up through the wellbore to the surface. At the surface, the drilling mud/fluid may be collected and recirculated through the drill tool. In the process of drilling the wellbore, the drilling mud forms a mudcake/filter cake on the wall of the wellbore that may act to separate the wellbore from the surrounding earth formation.

During the drilling of the wellbore and/or after drilling of the wellbore, it is often desirable to evaluate the earth formations penetrated by the wellbore. In some processes, the drilling tool may be provided with devices to test and/or sample the surrounding formation in processes often referred to as measurement while drilling. In other processes, the drilling tool may be removed from the wellbore and a wireline with one or more attached tools may be deployed into the wellbore to test and/or sample the earth formations adjacent to the wellbore. In yet other processes, the drilling tool itself may be used to perform the testing or sampling of the surrounding earth formations. The testing and sampling of the earth formations may provide for formation evaluation, such as locating hydrocarbons, determining the presence of non-hydrocarbon fluids, determining a composition of formation fluids present in an adjacent earth formation and/or the like.

In a formation evaluation process, it is often necessary to draw formation fluids from the formation into a downhole tool for testing and/or sampling. Various devices, such as probes or the like, may be extended from the downhole tool to establish fluid communication with the formation surrounding the wellbore and provide for drawing formation fluid from the formation into the downhole tool. Such a probe for formation sampling may be a circular element that may be extended from the downhole tool and contacted with and/or pushed into/through the sidewall of the wellbore. A rubber packer may be provided at the end of the probe to provide for sealing the probe with the sidewall of the wellbore. Another device that may be used to form a seal with the wellbore sidewall is commonly referred to as a dual packer. In a dual packer, two elastomeric rings expand radially about the tool to isolate a portion of the wellbore there between. The rings form a seal with the wellbore wall and permit fluid to be drawn into the isolated portion of the wellbore and into an inlet in the downhole tool.

The mudcake/filter cake lining the wellbore may be useful in assisting the probe, dual packers or the like in making the seal with the wellbore sidewall. Once the seal is made, fluid from the formation may be drawn into the downhole tool through an inlet by lowering the pressure in the downhole tool. Examples of probes and/or packers used in downhole tools are described in U.S. Pat. Nos. 6,301,959; 4,860,581; 4,936,139; 6,585,045; 6,609,568 and 6,719,049 and U.S. Patent Application No. 2004/0000433.

In the petroleum exploration and recovery industries, samples of formation fluids may be collected and analyzed for various purposes, such as to determine the existence, composition and producibility of subsurface hydrocarbon fluid reservoirs and/or the like. This aspect of the exploration and recovery process may be very important in developing drilling strategies and impacts significant financial expenditures and savings.

To conduct a valid fluid analysis, the fluid obtained from the subsurface formation should possess sufficient purity, or be virgin fluid, to adequately represent the fluid contained in the formation. As used herein, and in the other sections of this patent, the terms "virgin fluid", "acceptable virgin fluid" and variations thereof mean subsurface fluid that is pure, pristine, connate, uncontaminated or otherwise considered in the fluid sampling and analysis field to be sufficiently or acceptably representative of a given formation for valid hydrocarbon sampling and/or evaluation.

Challenges/issues may arise in the process of obtaining virgin fluid from subsurface formations with regard to accessing the formation fluids to be sampled/evaluated. With regard to the petroleum-related industries, the earth around the borehole from which fluid samples are sought typically contains contaminates, such as filtrate from the mud/fluids used in the drilling process. This material may contaminate the formation fluid as the mud/fluid passes through the borehole, resulting in a combination fluid that is not the same as the virgin formation fluid and is, therefore, not useful for the fluid sampling and/or evaluation processes. Such a combination of drilling and formation fluids may be referred to herein as "contaminated fluid" or the like. Since in order to sample formation fluid from areas surrounding the wellbore, the samples must be sampled through the wellbore and the mudcake, cement and/or other layers comprising/surrounding the wellbore sidewall, it is difficult to avoid contamination of the fluid sample as it flows from the formation and into a downhole tool during sampling.

Various methods and devices have been proposed for obtaining pure formation fluids for sampling and evaluation. For example, U.S. Pat. No. 6,230,557 to Ciglenec et al., U.S. Pat. No. 6,223,822 to Jones, U.S. Pat. No. 4,416,152 to Wilson, U.S. Pat. No. 3,611,799 to Davis and International Pat. App. Pub. No. WO 96/30628 describe, among other things, sampling probes and techniques for improving formation fluid sampling. Additionally, guarded probes, such as disclosed in U.S. Pat. No. 6,301,959 to Hrametz et al., have been disclosed for formation fluid sampling. In a guarded probe, a sampling probe is provided that comprises two hydraulic lines to recover formation fluids from two zones in the wellbore. In operation, wellbore fluids—such as drilling mud, drilling fluids, filtrates of the foregoing or the like—may be preferentially drawn into a guard zone, connected to one of the hydraulic lines, while formation fluids may be drawn into a probe zone, connected to the other hydraulic line. Thus, the probe zone may collect purer formation fluids for analysis. However, while guarded probes may provide for better sampling, they are in general expensive and more complicated to effectively operate then a nonguarded probe.

BRIEF SUMMARY OF THE INVENTION

Embodiments of the present invention relate to systems and methods for real-time management of formation fluid sampling down a wellbore using a guarded-probe-sampling-device. More specifically, but not by way of limitation, an embodiment of the present invention provides for real-time management of the sampling of fluids in an earth formation surrounding a wellbore by the guarded-probe-sampling-device, the real-time management of the fluid sampling by the guarded-probe-sampling-device comprising withdrawing fluids from the earth formation, sensing a physical or chemical property of the withdrawn fluids, outputting a signal corresponding to the sensed physical or chemical property, using the output signal to model properties of the withdrawn fluids, and using the modeled properties of the fluid sample for the real-time management of the sampling of the formation fluids.

In certain embodiments of the present invention, sensors may processing in real-time properties of fluids being collected by a sampling probe and/or a guard probe of the guarded-probe-sampling-device, wherein the processing may comprise analyzing differences in properties between fluid samples being collected by one or more guard devices and fluid samples being collected by one or more sampling probes. In certain aspects, the analyzing of the differences may comprise making predictions in real-time regarding present and future compositions of the fluids sampled by the guard and/or sampling probes based on the sensed properties of the fluid samples by fitting the collected sample-fluid data to various fluid sampling models. The various fluid sampling models may be mathematically derived models, experimentally derived models, models based upon prior formation fluid sampling and/or the like.

In one embodiment of the present invention, a fluid sampling device coupled with a wellbore tool may be lowered into a wellbore, wherein the fluid sampling device may comprise a sampling probe and a guard probe, and wherein the sampling probe and the guard probe may be disposed adjacent to one another and the sampling probe may be configured for withdrawing a first fluid sample from the formation and the guard probe may be configured for withdrawing a second fluid sample from the formation. In such an embodiment, the fluid sampling device may be maneuvered into contact with a wellbore sidewall and the first and the second fluid samples may be drawn from the formation. In certain aspects of the embodiment, once collected, properties of the first and second fluid samples may be sensed/identified and a processor may process in real-time a delta value, wherein the delta value comprises a difference between the sensed/identified properties of the two fluid samples and may be used to provide for real-time management of the sampling process/system. Sensing/identification of the properties of the fluid samples may comprise a sensor associated with one or more of the fluid samples generating a signal related to a property of the fluid sample or the like, wherein the signal may vary in accordance with the sensed property.

Merely by way of example, in certain aspects, the sampling probe may comprises an inner probe and the guard probe comprises an outer probe, wherein the outer probe surrounds the inner probe. In other aspects, the guard probe may comprise a plurality of probes that may be positioned adjacent to the sample probe so as to effectively guard the sample probe from contamination fluids.

In one embodiment of the present invention, the property of the first and the second fluid samples being sensed/measured by a sensor may be an amount of contaminating wellbore fluids sensed by the sensor in the fluid samples. In such an embodiment, a sensor, such as an optical fluid analyzer (hereinafter referred to as an "OFA") may produce an output signal that corresponds to an amount of wellbore fluid contaminants sensed by the sensor in the fluids flowing in the sampling or the guard probe. In certain aspects, by monitoring/processing a delta function, the delta function being the difference in such contaminants sensed in the sampling probe relative to those sensed in the guard probe, a maximum in the delta of the contamination amounts may be identified in real-time. The identified maximum may be processed by the processor and a signal may be communicated to operations at the surface that the sampling device is working. Additionally, a sample from the sample probe may be collected upon the occurrence of the maximum in the delta.

In other aspects, the delta between the contamination amounts may be processed for a predetermined period after the maximum is identified to determine whether the delta continues to decrease. After the predetermined period, if the delta has continued to decrease the signal that the sampling device is working may be sent to the operations at the surface and/or a sample may be collected from the sampling probe. The predetermined periods may be determined by mathematical analysis, modeling techniques, experimentation, previous sampling results and/or the like.

In certain aspects of the present invention, present and future composition of the fluid samples from the sample probe and/or the guard probe may be mathematically/theoretically extrapolated from the real-time delta readings. For example, information regarding the sampling process may be determined from, minima or maxima of the measured property or when the measured property tends towards an asymptote when compared against another fluid sampling variables, such as fluid flow or the like. The mathematical/theoretical extrapolation may be based upon mathematical models of downhole fluid sampling, models based on experiments with downhole fluid sampling, models based upon previous downhole fluid sampling results and/or the like.

In one embodiment of the present invention, the sampling probe may be maintained at a first pressure and the guard probe may be maintained at the same or a lower pressure. In certain aspects, the processor may control the pressure difference between the sample and guard probe. This control of the pressure difference may provide for control of the characteristics of the fluid samples collected by the sample and guard probes. In other features of the present invention, other aspects of the sampling process may be managed in real-time in accordance with the processed sampling predictions such as sampling duration, sampling location, heating the sampling probe and/or earth formation and/or the like.

BRIEF DESCRIPTION OF THE DRAWINGS

In the figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

The present invention will become more fully understood from the detailed description and the accompanying drawings, wherein.

DETAILED DESCRIPTION OF THE INVENTION

The ensuing description provides preferred exemplary embodiment(s) only, and is not intended to limit the scope, applicability or configuration of the invention. Rather, the ensuing description of the preferred exemplary embodiment (s) will provide those skilled in the art with an enabling description for implementing a preferred exemplary embodiment of the invention. It being understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments maybe practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Figure 1:
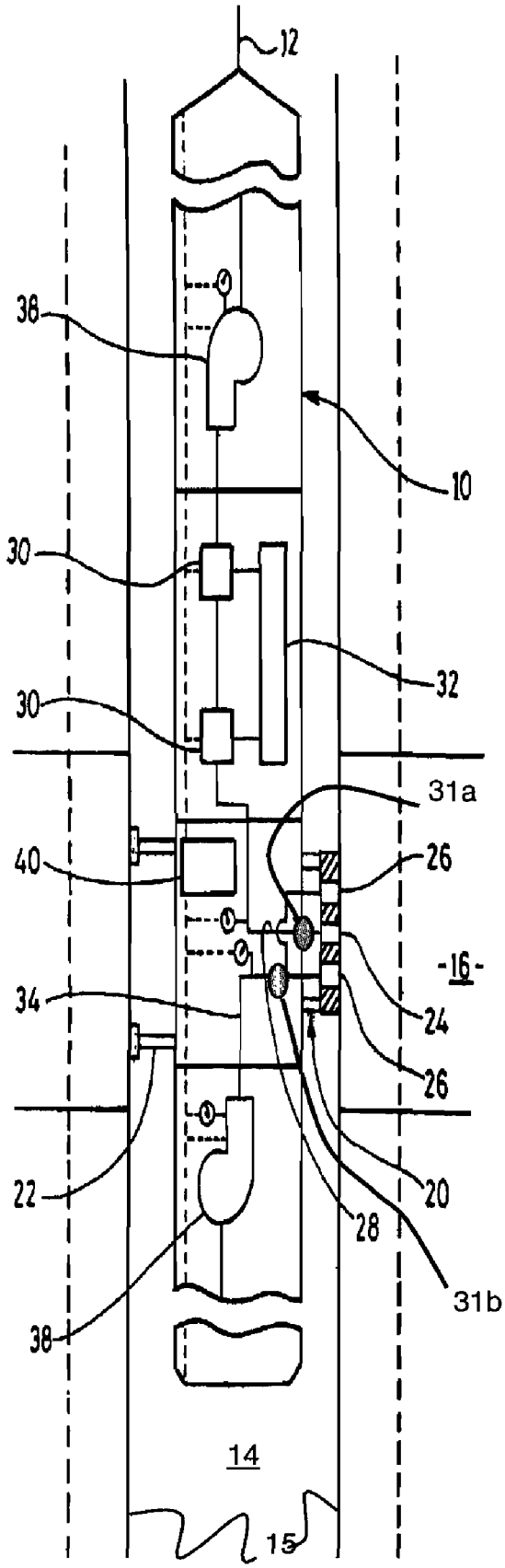
FIG. 1 is a schematic-type illustration of a fluid sampling apparatus, in accordance with an embodiment of the present invention, disposed in a borehole penetrating an earth formation, the fluid sampling apparatus comprising a borehole tool incorporating a sampling probe device through which fluid samples may be withdrawn from the formation.

With reference now to the drawings, the apparatus shown in FIG. 1 comprises a modular wellbore tool 10 suspended on a wireline 12—the wireline 12 may be a slickline, a drillstring or the like—in a wellbore 14 penetrating an earth formation 16. In certain situations, the earth formation 16 may contain exploitable, i.e., recoverable, hydrocarbons. The wellbore 14 comprises a sidewall 15. Surrounding the wellbore 14, up to a radial distance of the order of tens of centimeters, the sidewalls of the wellbore 14 may be adjacent to an invaded zone of the earth formation 16 into which contaminants from fluids flowing in the wellbore 14, such as filtrate from drilling mud used in the drilling of the wellbore 16 or the like, may have penetrated from the wellbore 14 into the sidewall 15 and the earth formation 16.

The wellbore tool 10 comprises a guarded sampling probe device 20 which is described in more detail hereinafter and which projects from the tool. In one embodiment of the present invention, the guarded sampling probe device 20 may be urged into contact with a part of the sidewall 15 that is adjacent to the earth formation 16. An anchoring device 22 may provide the urging of the guarded sampling probe device 20. In such an operation, the anchoring device 22 may be mounted on the side of the wellbore tool 10 and positioned substantially opposite to the guarded sampling probe device 20, which may be pressed against the sidewall 15 by the configuration of the wellbore tool 10 and the anchoring device 22.

The guarded sampling probe device 20 may comprise one or more of each of a sampling probe 24 and a guard probe 26. In certain embodiments, the one or more of the sampling probes 24 and the guard probes 26 may be distinct probes positioned adjacent to one another. In certain aspects, a plurality of guard probes 26 may be positioned adjacent to and around/surrounding a single one of the sampling probe 24. As depicted in FIG. 1, the guarded sampling probe device 20 may be configured to comprise the sampling probe 24 as an inner probe that may be surrounded by the guard probe 26. In certain aspects, respective flow areas of the sampling probe 24 and the guard probe 26 may be varied to provide for different sampling characteristics of the guarded sampling probe device 20.

In certain embodiments of the present invention, the sampling probe 24 may be selectively connectable, via a sampling outlet conduit 28 that may contain a pair of changeover (or diverter) valves 30, either to a sample chamber 32 or to a dump outlet (not shown). In such embodiments, the guard probe 26 may be coupled, via a guard outlet conduit 34, with a dump outlet (not shown). In some embodiments of the present invention, the guard probe 26 may also, like the sampling probe 24, be selectively connected via an outlet conduit and valves or the like to either a dump outlet or a sample chamber. As such, in operation of such embodiments, the sampling probe 24, the guard probe 26 and or a combination of both the sampling probe 24 and the guard probe 26 may be used to collect fluid samples from the earth formation 16.

In an embodiment of the present invention, both the sampling probe 24 and the guard probe 26 may be arranged to draw fluid samples from the earth formation 16. In certain aspects of the present invention, one or more pumps 38 and a control system 40, which may controls the valves 30 and the pumps 38 may be used to control the drawing of fluid samples from the earth formation 16 by the sampling probe 24 and the guard probe 26. Control of the fluid sampling may be provided by using the pumps 38 to change the pressure at the sampling probe 24 and/or the guard probe 26.

In an embodiment of the present invention, fluid sensors 31*a* and 31*b* may be used to measure properties of fluid samples obtained by the sampling probe 24 and the guard probe. The fluid sensors 31*a* and 31*b* may comprise OFAs, thermocouples, pressure sensors, flowmeters and/or the like. In certain embodiments, the fluid sensors 31*a* and 31*b* may be positioned in the sampling outlet conduit 28 and the guard outlet conduit 34, respectively. In other embodiments, a single sensor may take the place of the fluid sensors 31*a* and 31*b* and valves and controls in the sampling outlet conduit 28 and the guard outlet conduit 34 may be used to provide that fluids from the sampling outlet conduit 28 and the guard outlet conduit 34 are independently provided to the single sensor for sensing/analysis. The sensors 31*a* and 31*b* may output a signal S that varies in response to a composition of the fluid samples obtained by the sampling probe 24 and/or the guard probe 26 sensed by the sensors 31*a* and 31*b*. This signal S may vary in accordance with an amount of contamination in the fluid samples from the sampling probe 24 and/or the guard probe 26 that are sensed by the sensors 31*a* and 31*b*.

In an embodiment of the present invention, outputs from the sensors 31*a* and 31*b* may be coupled with a processor (not shown). The processor may use the outputs from the sensors 31*a* and 31*b* to determine in real-time a value of the property measured by the sensor. For example, the processor may process the output signal S from the sensors 31*a* and/or 31*b* and extrapolate an amount of wellbore fluid contamination in the samples in the sampling probe 24 and/or the guard probe 26. A flowmeter (not shown) may provide flow properties of the sampled fluids to the processor and the processor may process wellbore contamination volumes or changes in wellbore contaminations with flow volume and/or the like.

In a certain embodiment of the present invention, one of the sensors 31*a* and 31*b* may be used to sense a property of fluid sampled by the guarded sampling probe device 20. The one of the sensors 31*a* and 31*b* may be positioned within the guarded sampling probe device 20 or locations in fluid communication with the guarded sampling probe device 20. In such an embodiment, the processor may use an output signal from the one of the sensors 31*a* and 31*b* to model properties of the withdrawn fluids using mathematical modeling or the like. From the mathematical modeling of the fluids being sampled by the guarded sampling probe device 20, the processor may provide for the real-time management of the sampling of the formation fluids.

In one embodiment of the present invention, the processor may determine a delta value of the difference in properties of the fluids being sampled by the sampling probe 24 and the guard probe 26. Using these processed delta values, determinations may be made based upon mathematical extrapolation in real-time regarding management of the sampling process. In certain aspects, the processor may determine the occurrence of a maximum in the delta value and provide in real-time for collection of a fluid sample. In other aspects, after the occurrence of the maximum, the processor may process whether for a predetermined period the delta value is decreasing and upon the occurrence of such decreasing over the period may provide for collection of a fluid sample. In either aspect, the fluid sample may be obtained via the sampling probe 24, wherein the control system 40 operates pumps 38 to control the relative flow rates or pressures at the inner and outer probes 24, 26, and sets the valves 30 to direct the sample from the sampling probe 24 into the sample chamber 32.

In other aspects of the present invention, real-time management of the fluid sampling process may be provided based upon mathematical processing of the delta value. For example, as described in more detail below, based upon an assumption that the delta value may tend to an asymptote such as zero under sampling conditions wherein the content of the fluids sampled by the fluid sampling probe and the guard probe tend to the same composition and/or level of contamination by wellbore fluids, determinations as to when samples from the sampling probe 24 and/or the guard probe 26 may be determined. Using real-time processing of the delta function, it may be possible to collect fluid samples from both the sampling probe 24 and the guard probe 26 that contain essentially virgin formation fluids. This may speed up the sampling process, provide for larger sampling volumes and/or the like.

In some embodiments of the present invention, the processor may provide for controlling the pressure at the sampling probe 24 and/or the guard probe 26. Pressure control may be provided by controlling the pumps 38 and/or the like. Merely by way of example, if the delta value does not decrease after a maximum is detected or a maximum does not occur in the delta value or the like, pressure at the guard probe 26 may be decreased relative to the pressure at the sampling probe 24. In other examples, under such circumstances the positioning of the guarded sampling probe device 20, the sampling probe 24, the guard probe 24 and/or the like may be altered. In yet more examples, a heating device may be attached to the wellbore tool 10, the guarded sampling probe device 20, the sampling probe 24, the guard probe 24 and/or the like and may be used to heat the earth formation based upon processing of the measured properties of the fluids in the guarded sampling probe device 20. In this way, real-time management of the sampling process may be provided with control of sample characteristics, identification that the sampling system is working, alteration of sampling parameters when problematic sampling is determined and/or the like.

In the wellbore tool 10 of FIG. 1, fluid may be drawn into the sample chamber 32 without passing through the pump 38. In other embodiments, the fluid drawn into the wellbore tool 10 may pass through the relevant pump 38 en route to the sample chamber 32. In other embodiments, a single pump may be used in place of the two pumps 38 depicted in FIG. 1. Additionally, the conduit 34 may be provided with valves and a sample chamber analogous to the valves 30 and sample chamber 32, so that the fluid obtained via the outer probe 26 may be selectively retained or dumped.

Figure 2A:
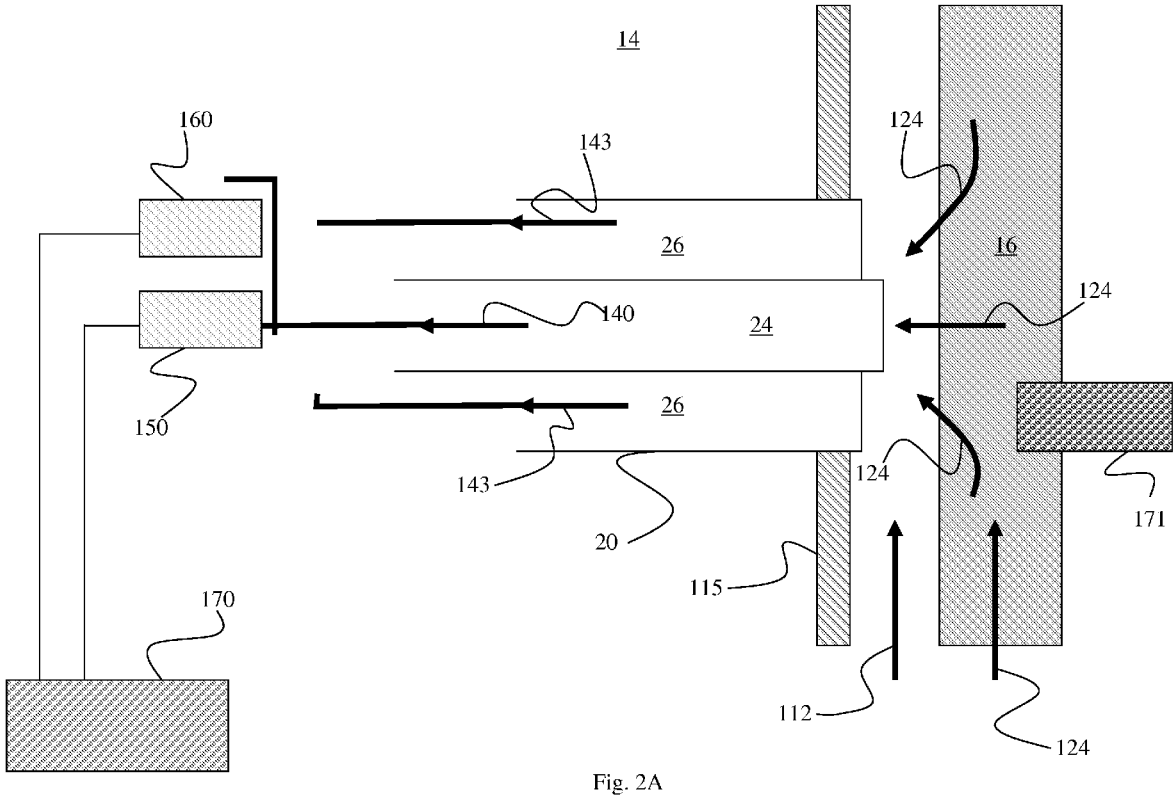
FIG. 2A is a schematic-type diagram illustrating a formation-fluid sampling system, in accordance with an embodiment of the present invention.

FIG. 2A is a schematic-type diagram illustrating a formation-fluid sampling system, in accordance with an embodiment of the present invention. In the depicted embodiment, the guarded sampling probe device 20 may be pushed into contact with a filter-cake layer 115 on the sidewall of the wellbore 14. The filter-cake layer 14 may comprise drilling mud, drilling mud components (mud filtrate), elements of drilling fluids, elements of wellbore fluids and the like. The guarded sampling probe device 20 may be configured so that the sampling probe 24 and/or the guard probe 26 penetrate the filter-cake layer 115. In certain aspects, the sampling probe 24 and/or the guard probe 26 may project from the guarded sampling probe device 20 to provide for penetration into the filter-cake. In some aspects, the sampling probe 24 may project beyond the guard probe 26 to provide for further penetration into the filter-cake layer by the sampling probe 24 relative to the guard probe 26. In certain aspects, the guard probes 26 may comprise independent probes disposed adjacent to the sampling probe 24. In other aspects, as depicted, the sampling probe 24 and the guard probe 26 may comprise a single probe encircling the sampling probe 24.

By reducing pressure at the sampling probe 24 and the guard probe 26, formation fluids 124 are drawn from the formation into the sampling probe 24 and the guard probe 26. However, contaminants 112, such as mud filtrate and other fluids that may be in the wellbore 14, may also be drawn to the sampling probe 24 and the guard probe 26. The guard probe 26 may draw the contaminants 112 that otherwise might enter the sampling probe 24 to provide that in operation, after a period of time, substantially pure formation fluids enter the sampling probe 24. The pressure at the sampling probe 24 and the guard probe 26 may be controlled by one or more pumps or the like. A sample fluid 140 in the sampling probe 24 may be passed to a sample sensor 150 for analysis. Similarly, a guard fluid 143 may be passed to a guard sensor 160 for analysis. In certain aspects, the sample sensor and the guard sensor may comprise a single sensor and the sample fluid and the guard fluid may be provided to the single sensor independently, by the use of valves or the like, for analysis.

Output from the sample sensor and the guard sensor may be provided to a processor 170. In an embodiment of the present invention the processor 170 may determine a delta of the difference between the outputs from the sample sensor and the guard sensor. From this delta, the processor 170 may, in real-time, establish occurrence of a maximum in the delta and may model a function to fit the delta obtained from the outputs from the sample sensor and the guard sensor. The processor 170 may use the delta to manage the sampling process. This management may include determining from a maximum in the delta that the guarded sampling probe device 20 is working correctly, wherein to work correctly the guard probe 26 draws off the contaminants 112 and the sampling probe 24 draws off essentially virgin formation fluid. In some aspects of the present invention, this determination of correct functionality of the guarded sampling probe device 20 may include monitoring of the outputs from the sampling probe 24 and the guard probe 26 for a period after the maximum. During this period, for correct functionality, the delta should decrease. Length of the period used in the determination and/or variances in the expected decrease in the delta may be determined experimentally, from prior downhole measurements, from mathematical analysis or modeling and/or the like.

In some embodiments of the present invention, the processor 170 may process the outputs from the sample sensor and the guard sensor to determine in real-time expected contamination levels for the sampling probe 24 and the guard probe 26. From such computations, the processor may manage the guarded sampling probe device 20. Such management of the guarded sampling probe device 20 may include instructing the guarded sampling probe device 20 to provide for collection of samples from the sampling probe 24 and/or the guard probe 26, altering the pressure at the sampling probe 24 and/or the guard probe 26 to provide for changes to the flow of the formation fluid 124 and/or the contaminants 112 into the sampling probe 24 and the guard probe 26, changing the position/orientation of the guarded sampling probe device 20 relative to a sidewall of the wellbore and/or the earth formation 16, changing the alignment/relative position of the sampling probe 24 and the guard probe 26 and /or the like. In certain aspects, management of the fluid sampling may comprise using a heating device 171 to heat the earth formation 16, the sidewall 115, the formation fluids 124 and/or the like. Such heating may be used in response to modeling of viscosity of the fluid samples being withdrawn or the like. Using processing of the delta, the guarded sampling probe device 20 may be used as an intelligent sampling probe that may be adjusted and maneuvered in real-time to provide for more efficient, quicker and controlled sampling of formation fluids.

Figure 2B:
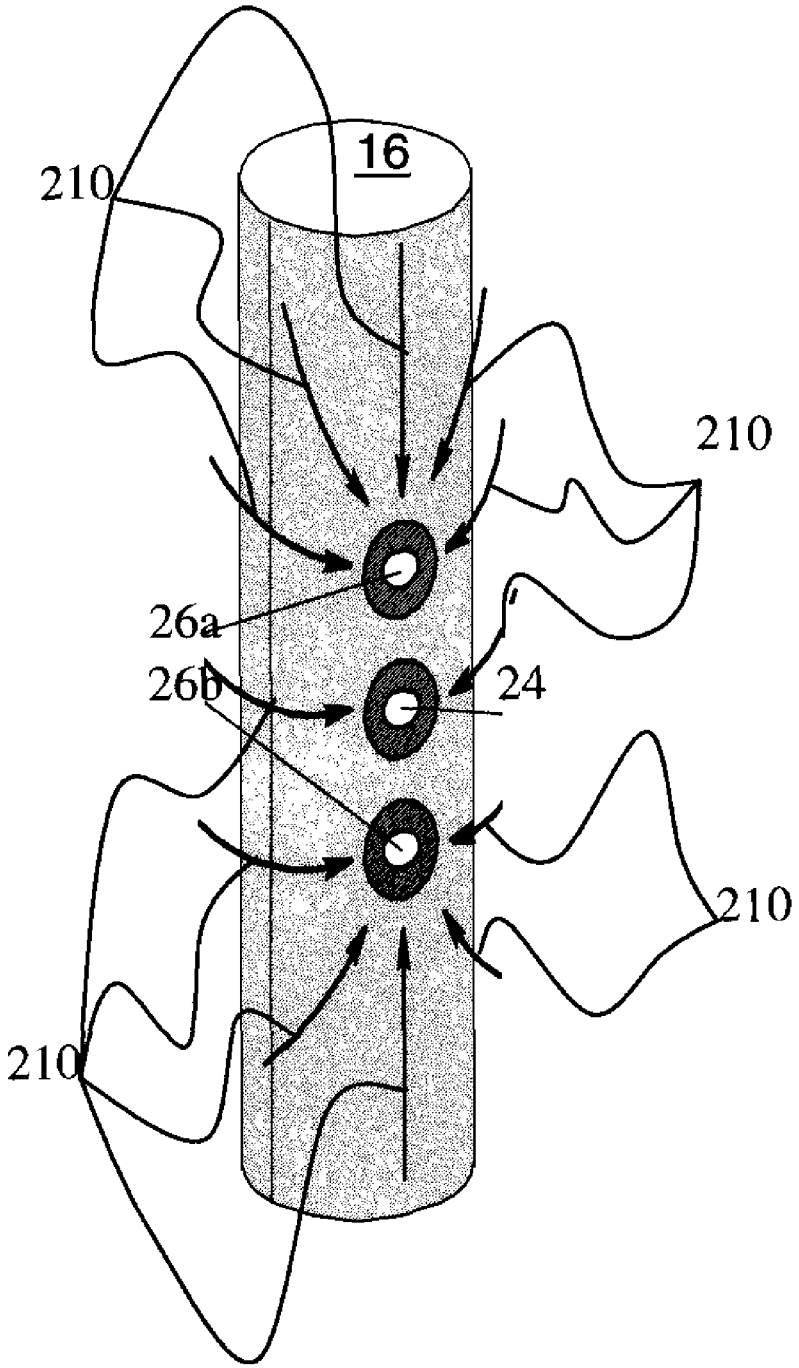
FIG. 2B is a schematic-type diagram illustrating a fluid sampling probe for use in a formation-fluid sampling system, in accordance with an embodiment of the present invention.

FIG. 2B is a schematic-type diagram illustrating a fluid sampling probe for use in a formation-fluid sampling system, in accordance with an embodiment of the present invention. In some embodiments of the present invention, the wellbore tool 16 may comprise the sampling probe 24 and a plurality of the guard probes 26a and 26b disposed around/adjacent to the sampling probe 24. A downhole fluid 210 may flow to the sampling probe 24 and the plurality of the guard probes 26*a* and 26*b*. Different positions of the guard probes 26*a* and 26*b* relative to the sampling probe 24 may provide for different fluid sampling characteristics of a guarded sampling probe device. Using embodiments of this invention, the sampling characteristics may be determined in real-time. As such, in certain aspects the arrangement of the sampling probe 24 and/or the guard probes 26*a* and 26*b* may be changed based upon real-time analysis. Additionally, pressures at one or more of the sampling probe 24 and the guard probes 26*a* and 26*b* may be managed in real-time.

Figure 3A:
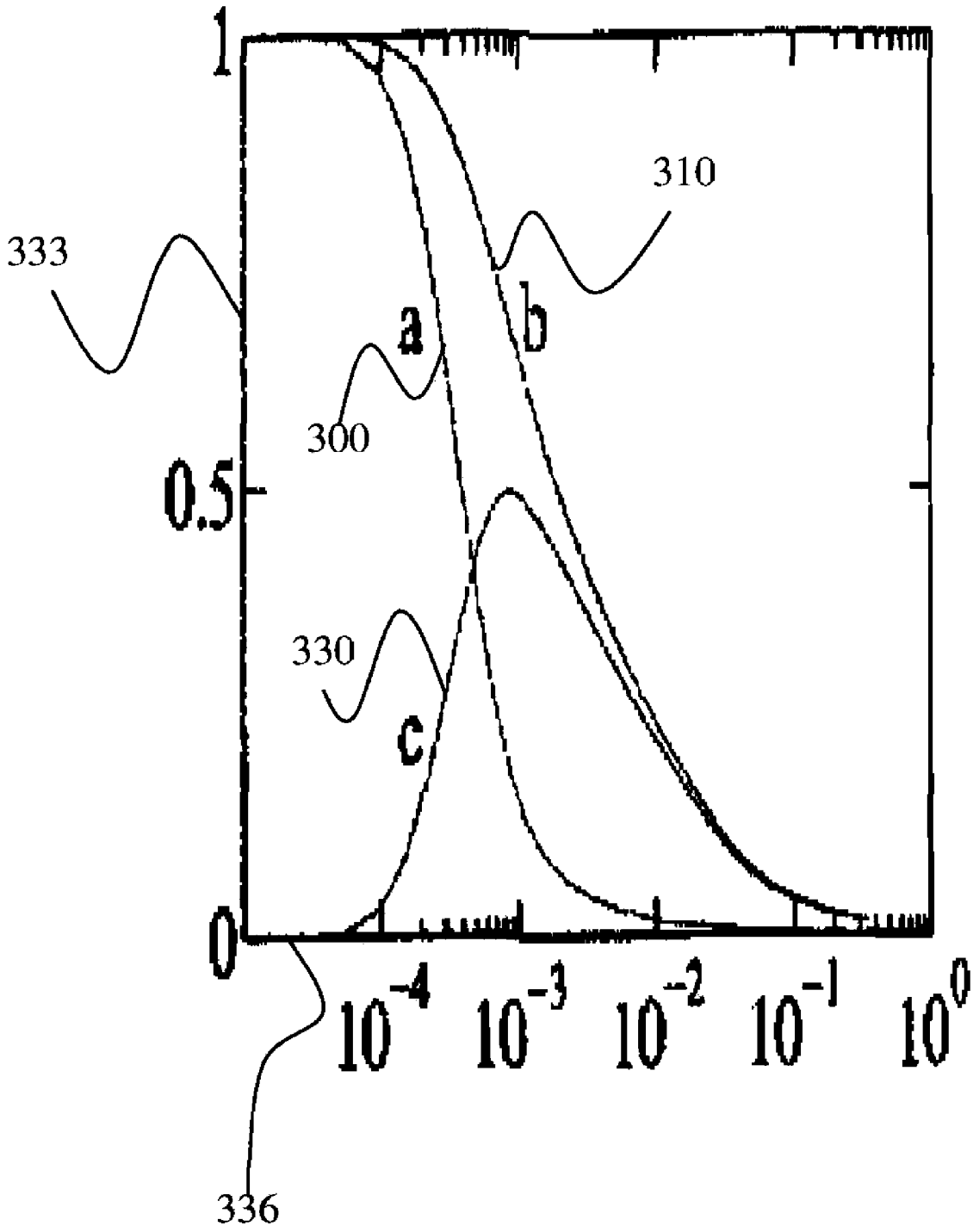
FIG. 3A illustrates predicted contamination amounts in a guard probe and a sampling probe and a delta of the difference between the contamination in the probes as the contamination and delta vary with time during operation of a formation-fluid sampling system using software modeling, in accordance with an embodiment of the present invention.

FIG. 3A illustrates contamination amounts in a guard probe and a sampling probe and a delta of the difference between the contamination in the probes as the contamination and delta vary with time during operation of a formation-fluid sampling system, in accordance with an embodiment of the present invention. As depicted, a sample variant 300 illustrates a contamination level of a sample in the sampling probe and the guard variant 310 illustrates a contamination level of a sample in the guard probe. The sample variance 300 and the guard variance 310 are plotted on a contamination level 333 versus a pumped sample volume 336 The sample variance 300 and the guard variance 310 may be determined from prediction, experimentation, measurements from the wellbore mathematical modeling or the like.

In FIG. 3A, the sample variance 300 and the guard variance 310 are illustrated based upon a prediction that at the start of sampling the fluid sampling probe and the guard probe will both receive contaminated samples and after as sampling continues the amount of contamination in the fluid sampling probe and the guard probe will decrease with the contamination decreasing faster in the fluid sampling probe, due to the guard probe drawing contaminants away from the fluid sampling probe. A delta variance 330 illustrates a difference between the contamination in fluid sampled by the fluid sampling probe and fluid samples by the guard probe. As discussed above, analysis of this delta in real-time may provide for real-time management of the sampling probe device.

In an embodiment of the present invention, sensor data from both the guard and sampling flow lines may be retrieved and provided to a processor. Initially both flow lines withdraw fluid from the sampling and guard probes that may be equally (and highly) contaminated by drilling fluid filtrate. As such, sensor data from the two flow lines may be substantially identical. Contamination first decreases in the inner sampling probe and the difference between the two sets of data initially increases. In certain configurations, contamination may later decreases in the outer, guard probe and the difference between the two sets of data decreases towards zero. Identification of s maximum (or minimum) in the difference curve indicates that the guarded probe is working. In certain aspects, data may be extrapolated by fitting to a power-law in order to determine how much longer pumping of fluid samples may be needed to obtain a pore-fluid sample with an acceptably small contamination. In the modeling aspects, it may be assumed that the difference or delta value between the samples from the guard and the sampling probe decrease towards zero, which may make extrapolation easier.

In certain aspects, the present invention may provide for obtaining sensor signals from the flow lines of both the sampling probe and the guard probe. To provide for real-time management, in certain embodiments, these signals may either be identical when the two flow lines contain identical fluid or may be normalized to provide that the signals are effectively identical. Normalization may be achieved by diverting the two flow lines alternately through a single sensor. Alternatively, two separate sensors may be at least partially calibrated downhole using drilling fluid filtrate obtained from the wellbore.

In some aspects of the present invention, sensor data for the sampling and guard probes may be monitored separately, and the difference between the signals may be computed and monitored. In certain modeling analysis, it may be that the difference between the two sets of data initially increases as the sampling probe contamination decreases towards zero. Determination of a maximum or minimum in the difference or delta curve may provide for an indication that the guard probe is working, and that subsequent data may be extrapolated, e.g. by fitting to a power-law. Such monitoring and extrapolation may provide for improved control and/or prediction of the level of contamination and may provide that the time at which a fluid sample starts to be collected may be better controlled.

The difference between the two sets of sensor data may eventually tends to zero, since both the sampling and guard probes may be configured to eventually collect pure formation fluid. Mathematical extrapolation and control of the probe device may be made easier by monitoring sensor data regarding both the sampling and guard probe because it may be easier to determine the rate of decay of a signal that tends to zero than to determine the evolution of a signal that tends to an (unknown) nonzero value. The contamination in the guard probe can therefore be monitored more easily than from guard-probe data alone. Moreover, the power-law decay of contamination in the guard probe gives an upper bound to contamination in the inner sampling probe.

In some embodiments of the present, when extrapolation of power-law data for the sampling probe proves to be difficult, the data can be extrapolated using the power-law exponent obtained for the guard probe. Further, if the two sets of data eventually indicate that fluid in the two flow lines may be identical, the required sample of fluid can be collected more rapidly using both the sampling and guard flow lines, rather than just the sampling flow line.

The following descriptions provide examples of aspects of the present invention in which several modeling techniques are described that may be used to extrapolate data from a guarded probe system. In different embodiments of the present invention, other modeling techniques may be used to model the fluid sampling to provide for real-time management of the sampling process.

In example one, the earth formation may be considered as a plane rock face. In such a modeling case, the probe may be considered as having a radius $\alpha$, the depth of filtration invasion may be considered as $\beta\alpha$, the rock porosity may be considered as $\phi$ and the total rate of pumping as Q, so that the volume pumped at time t is V=Qt. The interface between original formation fluid and filtrate may be assumed to be initially sharp and to remain so (one of the many simplifications of the model). In the example, a spherical flow approximation may be used to provide that original formation fluid first reaches the probe at time $$T=2\pi\beta^3\alpha^3\phi/(3Q).$$

Such a model may not be substantially realistic, but the model may be treated analytically and, as such, may serve to demonstrate the ideas involved in the modeling process.

In the extrapolation, the contamination of filtrate at time t in the combined sampling/guard probe may be represented by:

$$F=1 \text{ for } t<T \tag{1a}$$

$$F=(T/t)^{1/3} \text{ for } t>T \tag{1b}$$

For the modeling analysis, it may be supposed that the inner sampling probe has been designed such that it takes a fraction $\gamma$ of the total flow Q, with a fraction $1-\gamma$ going into the outer guard probe. Moreover, when the filtrate fraction $F=(T/t)^{1/3}=1-\gamma$, the sampling probe may become free of filtrate and original formation fluid may start to enter the guard probe. As such, the model may be used to predict that the contamination $F_s$ in the inner sampling probe may be provided by:

$$F_s = 1 \text{ for } t < T \tag{2a}$$

$$F_s = 1\square\frac{1}{\square}\left[1\square\left(\frac{T}{t}\right)^{\frac{1}{3}}\right] \text{ for } T < t < T(1-\gamma)^{-3} \tag{2b}$$

$$F_s = 0 \text{ for } T(1-\gamma)^{-3} < t \tag{2c}$$

Similarly, the contamination $F_g$ within the outer guard probe may be provided by:

$$F_s=1 \text{ for } t<T(1-\gamma)^{-3} \tag{3a}$$

$$F_s=(T/t)^{1/3}(1-\gamma)^{-1} \text{ for } T(1-\gamma)^{-1}<t \tag{3b}$$

Applying the supposition that the sensor signal S depends linearly upon the filtrate concentration F, with:

$$S=c+dF \tag{4}$$

for some calibration constants c and d, the difference between the signal $S_s$ in the sampling flow line and $S_g$ in the guard flow line may be monitored. By taking the difference, the unknown baseline S=c resulting from pure original formation fluid may be removed, which unknown may cause problems when studying the decay of contamination in a single unguarded probe. The difference between the signals may then be provided by:

$$S_s-S_g=d(F_s-F_g) \tag{5a}$$

which is:

$$= 0 \text{ for } t < T \tag{5b}$$

$$= -\frac{d}{\gamma}\left[1-\left(\frac{T}{t}\right)^{\frac{1}{3}}\right] \text{ for } T < t < T(1-\gamma)^{-3} \tag{5c}$$

$$= -\frac{d}{1-\gamma}\left(\frac{T}{t}\right)^{\frac{1}{3}} \text{ for } T(1-\gamma)^{-3} < t \tag{5d}$$

This difference may achieve a minimum value $S_s-S_g=-d$ at time $t=T(1-\gamma)^{-3}$ when $S_s=c$ and $S_g=c+d$. This minimum may be smeared out by dispersion etc., but may still be recognizable. Furthermore, the minimum may be identified by evaluating behavior of the difference around the minimum.

Figure 3B:
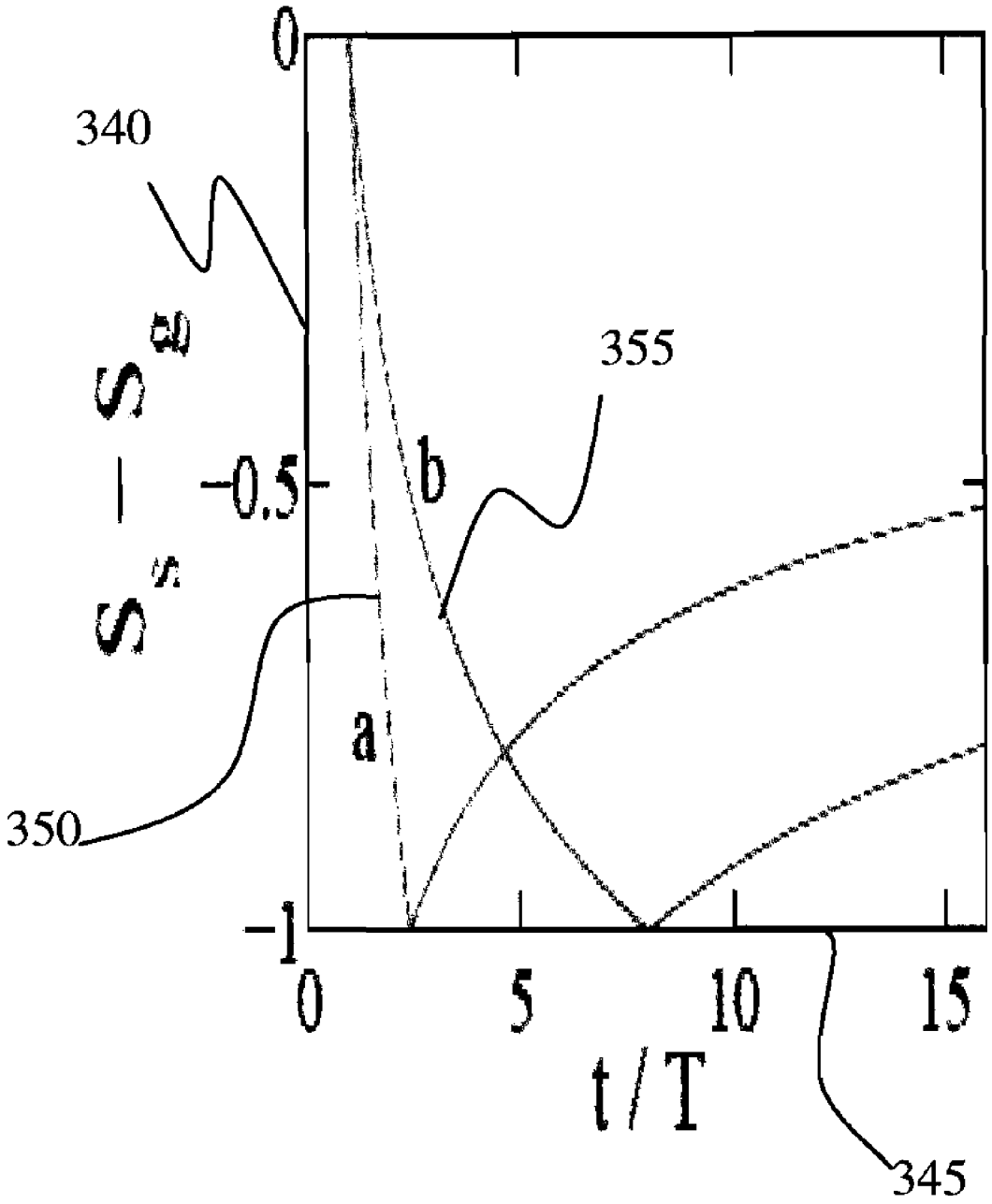
FIG. 3B illustrates predicted contamination amounts in a guard probe and a sampling probe and a delta of the difference between the contamination in the probes as the contamination and delta vary with time during operation of a formation-fluid sampling system using software modeling and shown on a log-log axes, in accordance with an embodiment of the present invention.

To demonstrate the signal modeling as described above, d may be set to d=1 and two cases may be considered: (a) $\gamma=0.25$; and (b) $\gamma=0.5$. FIG. 3B illustrates a difference $(S_s-S_g)$ 340 plotted against t/T 345, and shows that the difference attains the same value $-S_s-S_g=-1$ for both values of $\gamma$. As depicted, a line a 350 depicts the change in contamination $F_s$ in the sampling probe and a line b 355 depicts the change in contamination $F_g$ in the guard probe.

The analysis of the fluid sampling may be more precisely modeled in examples in which the wellbore may be treated as being cylindrical. The geometry of a guarded probe being used for sampling against a cylindrical wellbore may be difficult to process analytically. As such, software simulations may be used to provide for modeling of the sampling and behavior of the fluids. In this way, the fluid sampling in the cylindrical wellbore may be analyzed using a "standard rectangular probe grid" together with a simple probe configuration in which the sampling probe occupies 0.25 of the total probe surface area. The viscosities of the original formation fluid and filtrate may be assumed to be identical and the interface may be treated as being initially sharp at a radial distance 29.9 cm from the axis, compared to the wellbore radius 15 cm.

Figure 3C:
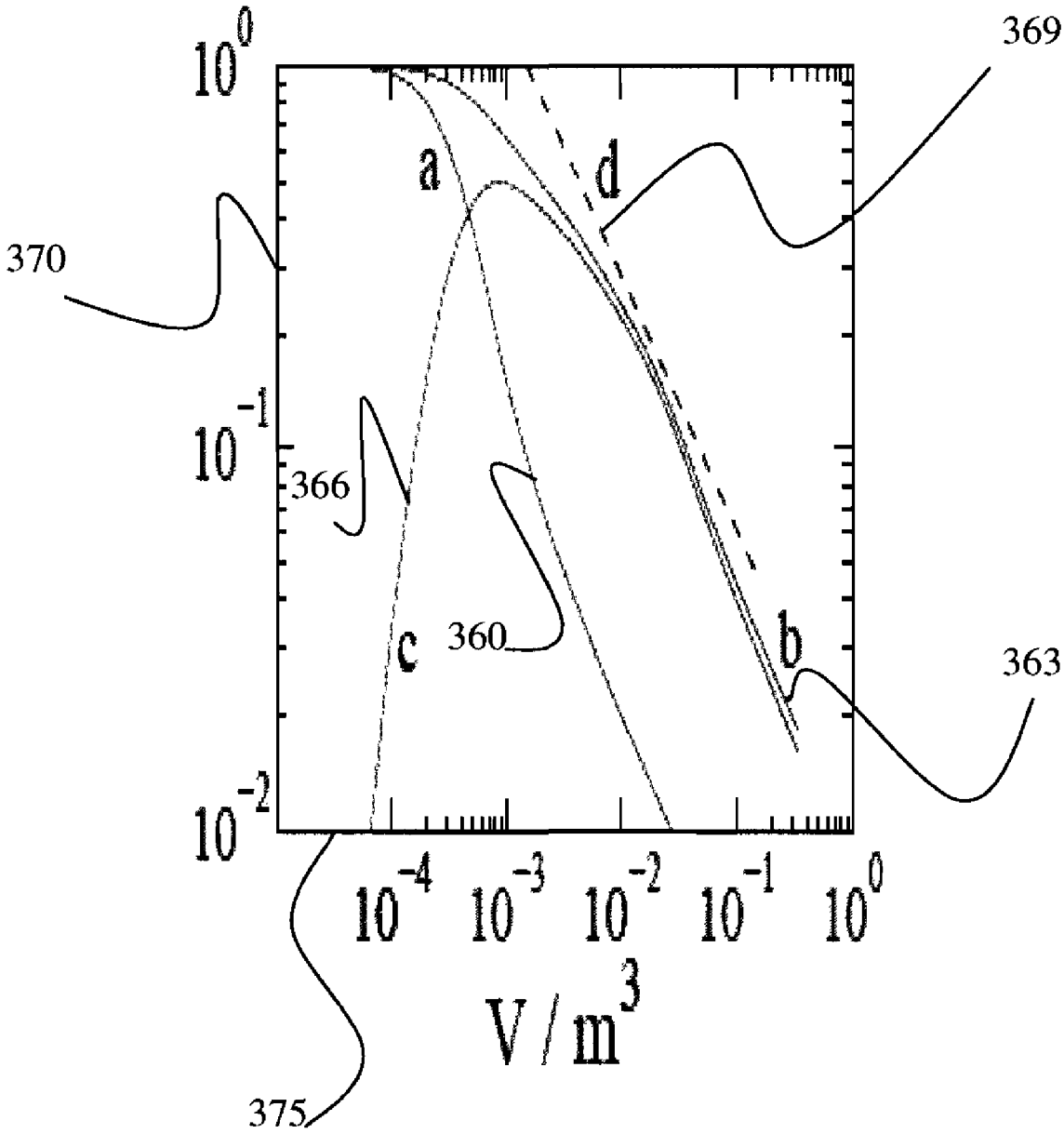
FIG. 3C illustrates predicted contamination amounts in a guard probe and a sampling probe and a delta of the difference between the contamination in the probes as the contamination and delta vary with time during operation of a formation-fluid sampling system using mathematical modeling of the guarded probe being used with a plane formation face, in accordance with an embodiment of the present invention.

FIG. 3C illustrates predictions for (a) the contamination $F_s$ in the sampling probe, shown as line a 360, (b) the contamination $F_g$ in the guard probe, shown as line b 363, and (c) the difference $F_s-F_g$, shown as line c 366 all as functions of contamination in a sample 370 versus a total volume V pumped into the combined guard+sampling probe 375.

From the figure, it may be seen that line c 366 has a maximum when the sampling probe contamination has dropped to $F_s\approx0.15$ (i.e. 15% contamination). The figure also shows that contamination $F_g$ in the guard probe starts to drop before contamination $F_s$ in the sampling probe has become zero. As a result, the difference $F_s-F_g$ achieves a maximum value 0.5, rather than the value 1.0 predicted by the analysis of the plane rock face, provided above. Nevertheless, the maximum may be robust, and may be still easily identifiable.

Theoretical predictions may provide that the contamination should decay ultimately as $V^{-2/3}$, shown as plot d 369 in FIG. 3B. Eclipse simulations usually show this behavior only after an exceedingly large volume has been pumped. At shorter times the slope of a log-log plot approaches −2/3 continuously, passing through the value −5/12, which has been observed in the field. After a very large volume has been pumped the computed results may be affected by the finite size of the reservoir modeled within ECLIPSE, and the filtrate contamination may fall off more rapidly than $V^{-2/3}$ as seen in figure.

Computations give filtrate contaminations $F_s$ and $F_g$, which decay to zero. However, the sensor signal (4) tends to an unknown constant c corresponding to pure original formation fluid. Extrapolation of results in real time, to predict the rate of decay of contamination, may be difficult because c may be unknown. By subtracting two sets of data from identical sensors, this baseline offset can be eliminated. As such, extrapolation of the rate of decline of contamination may be much easier.

To further understand the contamination in the probe, curve fits to the data from analysis of the cylindrical wellbore as provided above may be ascertained. Curve fits to the above figures may be obtained using a NAG routine E04GZF least-squares fit to sets of 10 successive results produced by the ECLIPSE simulation. The maximum in $F_g-F_s$ shown in FIG. 3A, occurred at a pumped volume $V_{max}=8.8\times10^{-4}$ m$^3$. Data for $V<V_{max}$ was discarded, and the first fit was obtained after a further 10 data points were examined, i.e. at $V=8\times10^{-3}$ m$^3$. The NAG routine was not satisfied that the best fit had been found at early times. Taking advantage of the fact that $F_g-F_s$ decays to zero, the fit may be obtained such that:

$$F_g-F_s\approx\beta_1 V^{\alpha 1} \tag{6}$$

Figure 4A:
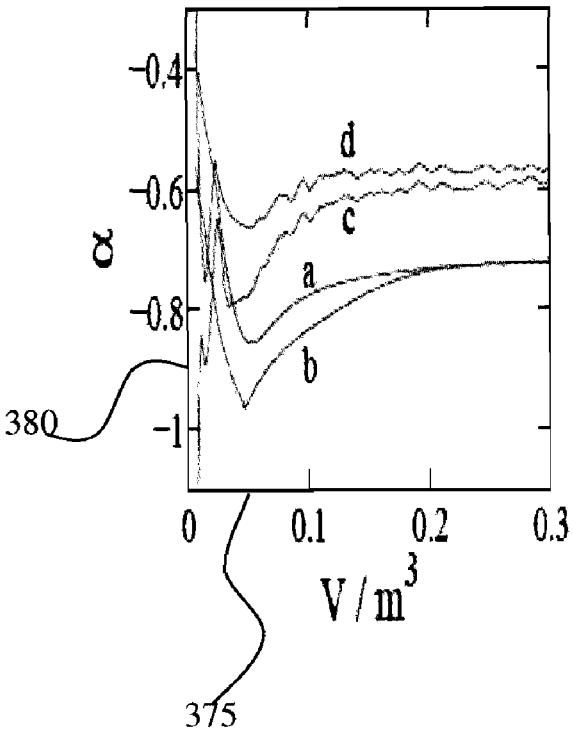
FIGS. 4A-D coefficients of power law fits to predictions of contamination amounts in a guard probe, in accordance with an embodiment of the present invention.
Figure 4B:
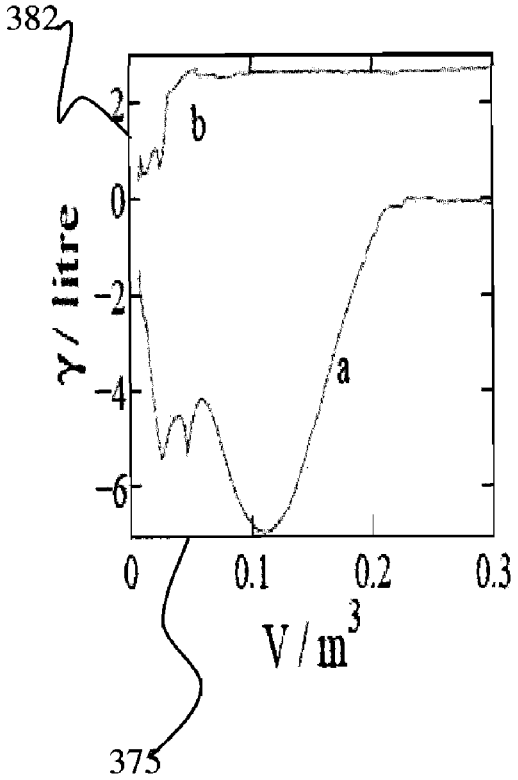
Figure 4C:
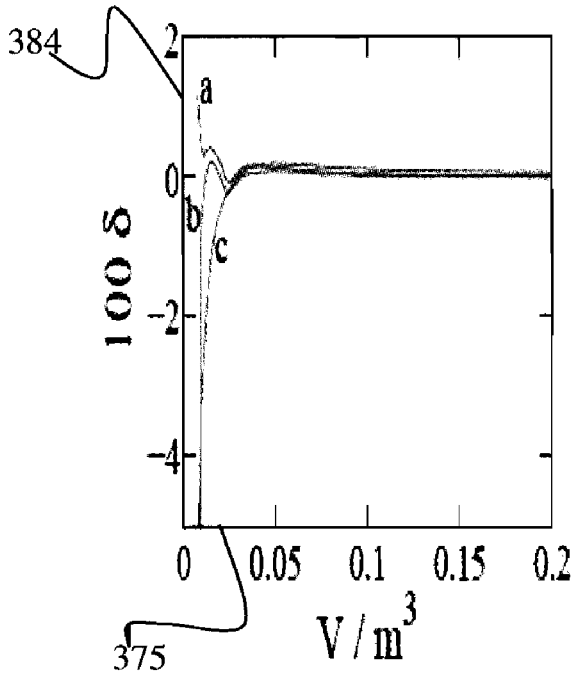
Figure 4D:
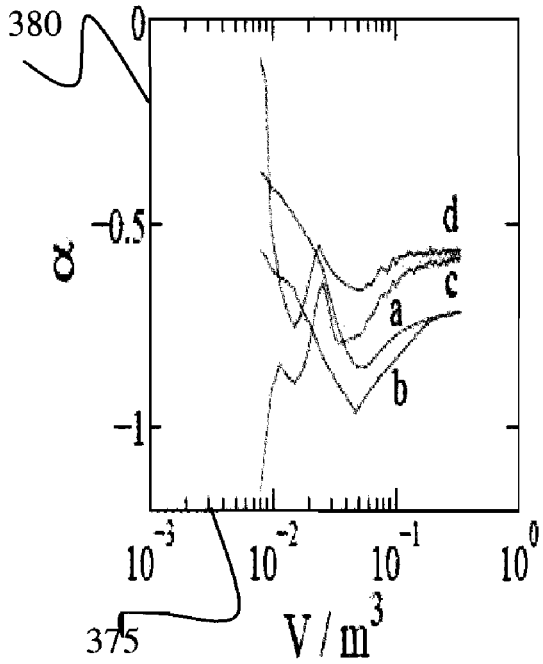

The exponent $\alpha$1 is shown as curve (a) in FIG. 4A, and re-drawn as a function of log(V) in FIG. 4D. If the time at which pumping started is not known precisely, or if the fit to (6) is poor, a fit of the following form, may be used:

$$F_g-F_s\approx\beta_3(V-\gamma_2)^{\alpha 2}$$

The exponent $\alpha$2 is shown as curve (b) of FIG. 4A, where $\alpha$ 380 is plotted versus the total volume V pumped into the combined guard+sampling probe 375, and differs from $\alpha$1 only at small V. The offset volume $\gamma$2 is shown as curve a of FIG. 4B, where $\gamma$ 382 is plotted versus the total volume V pumped into the combined guard+sampling probe 375, and is always small compared to V. The simulated data for $F_s$ tend to zero as $V\rightarrow\infty$, but sensor data tend to some (unknown) constant. Therefore, a fit to the sampling probe data may be provided by:

$$F_s\approx\beta_3 V^{\alpha 3}+\delta_3$$

The exponent $\alpha$3 is shown as curve (c) of FIG. 4A. The obtained data is quite noisy, no doubt, because the changes in $F_s$ are by this stage small. The fit predicts that $F_s\rightarrow\delta_3$, which is known to be zero. The value $\delta_3$ obtained by the least-squares fit is shown as curve (a) of FIG. 4C, where $\delta$ 384 is plotted versus a total volume V pumped into the combined guard+sampling probe 375, and is indeed small. Allow for an offset volume $\gamma_4$ in the data for $F_s$, a fit of the following form may be found:

$$F_s\approx\beta_4(V^{\alpha 4}-\gamma_4)+\delta_4 \tag{9}$$

This fit settles down more quickly than does the fit provided in equation (8), with $\alpha_4$ shown as curve (d) of FIG. 4A and $\gamma$4 as curve (b) of FIG. 4B. $\delta_3$ is shown as curve (b) of FIG. 4C. However, there seems to be no major advantage in using the more complicated equation (9) instead of equation (8) on this particular set of data.

Finally, a simple fit, which makes use of $\alpha$1, may be used and determined from the difference data by means of equation (6). This fit is provided by:

$$F_s\approx\beta_4 V^{\alpha 1}+\delta_5 \tag{10}$$

and provides for the extrapolation and prediction of the final value $\delta_5$, shown as curve (c) of FIG. 4C, though it provides a poorer fit than either fit equations (8) or (9) when V is small.

Figure 5:
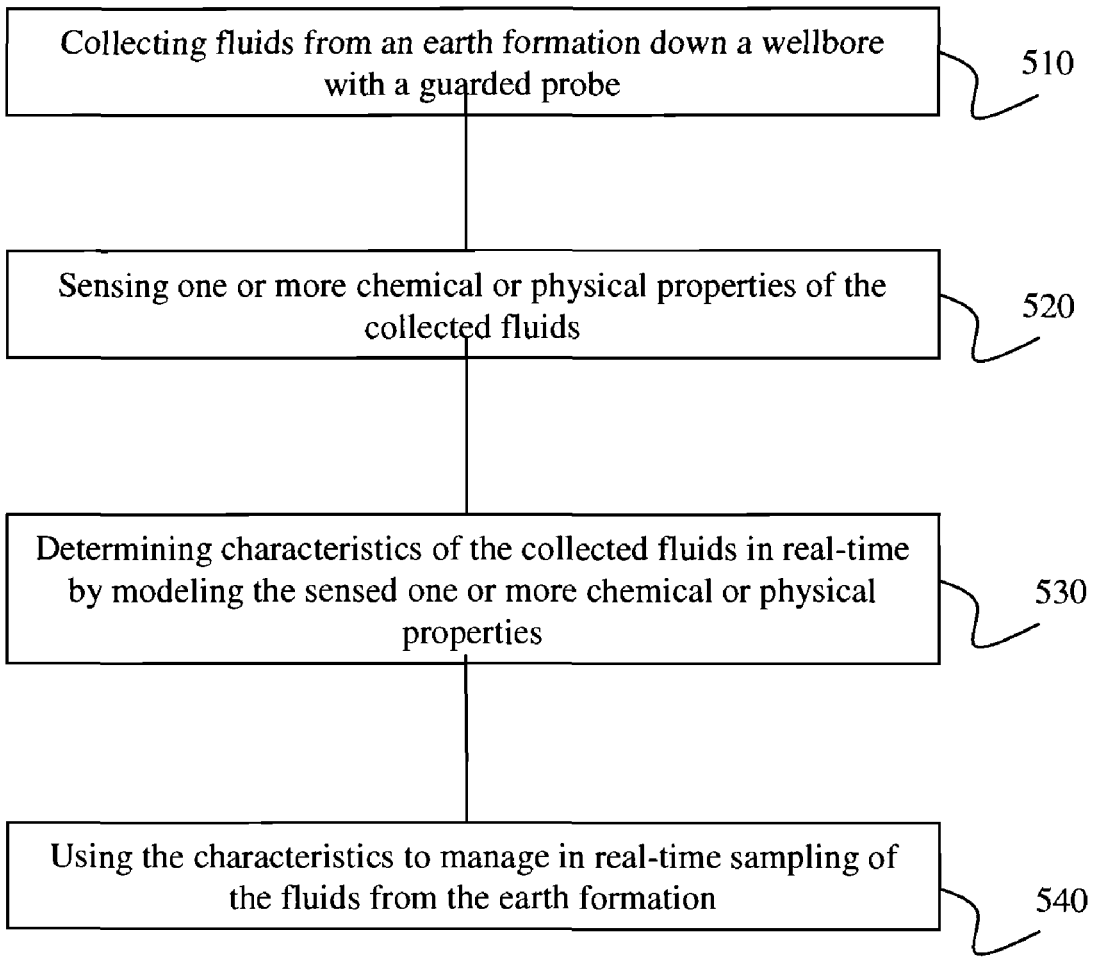
FIG. 5 is a flow-type schematic illustrating functionality of a method for managing downhole sampling with a guarded probe in real-time.

FIG. 5 is a flow-type schematic illustrating functionality of a method for managing downhole sampling with a guarded probe in real-time. In step 510, a wellbore tool coupled with a guarded probe may be positioned downhole to provide for withdrawing fluids from an earth formation adjacent to the wellbore. The fluids retrieved from the guarded probe may include wellbore fluids that may include drilling fluid filtrate. In step 520, the fluids withdrawn by the guarded probe may be sensed by a sensor that may generate a signal corresponding to one or more chemical or physical properties of the withdrawn fluids. In certain aspects, the sensor may be an OFA and may generate a signal corresponding to an amount of the wellbore fluids sensed. In other aspects, the sensor may be a temperature sensor, a pressure sensor, a viscosity sensor, a sensor of for a particular chemical or group of chemicals or the like.

In step 530, a determination regarding the characteristics of the collected fluids may be made in real-time by processing the outputs received from the sensor for the one or more chemical or physical properties of the withdrawn fluids. Processing may be performed by a processor, software program or the like. Processing may comprise making predictions regarding the characteristics of the withdrawn fluid samples by applying the outputs from the sensor to a model, i.e. modeling the sensor outputs. The model may be a mathematical model, an experimental model, a model based on prior sampling in similar situations (i.e. similar earth formations, similar wellbores, similar depth sampling, similar drilling fluids and/or the like) and/or the like.

In step 540, the characteristics of the withdrawn fluids predicted in real-time by the processing of the outputs from sensing of the withdrawn fluids may be used to manage in real-time the sampling of fluids from the earth formation. For example, from signals from sensors corresponding to sensed wellbore fluid contamination of the withdrawn fluids, real-time predictions regarding contamination of the withdrawn fluids may be processed and a determination may be made in real-time as to when to sample the withdrawn fluids to provide samples of virgin formation fluids. Such determinations of predicted contamination of the withdrawn fluids may also include determining flow properties of the withdrawn fluids to provide for determining contamination per volume or the like. Management of the guarded probe fluid sampling process in real-time may also include repositioning the guarded probe, determining in real-time that the guarded probe is functioning correctly, changing suction/pressures associated with the sampling process, heating the earth formation, formation fluids and/or the like, back-flushing the guarded probe and/or the like.

In the foregoing description, for the purposes of illustration, various methods and/or procedures were described in a particular order. It should be appreciated that in alternate embodiments, the methods and/or procedures may be performed in an order different than that described. It should also be appreciated that the methods described above may be performed by hardware components and/or may be embodied in sequences of machine-executable instructions, which may be used to cause a machine, such as a general-purpose or special-purpose processor or logic circuits programmed with the instructions, to perform the methods.

Hence, while detailed descriptions of one or more embodiments of the invention have been given above, various alternatives, modifications, and equivalents will be apparent to those skilled in the art without varying the invention. Moreover, except where clearly inappropriate or otherwise expressly noted, it should be assumed that the features, devices and/or components of different embodiments may be substituted and/or combined. Thus, the above description should not be taken as limiting the scope of the invention, which is defined by the appended claims.

What is claimed is:

1. A method, comprising:

conveying a wellbore tool in a wellbore extending into an earth formation, wherein:

the wellbore tool comprises a fluid sampling device;

the fluid sampling device comprises:

an inner probe configured to withdraw a first fluid sample from the formation; and an outer probe surrounding the inner probe and configured to withdraw a second fluid sample from the formation;

urging the fluid sampling device into contact with a wall of the wellbore;

withdrawing the first and the second fluid samples from the formation while:

maintaining the inner probe at a first pressure; and maintaining the outer probe at a second pressure, wherein the first pressure is higher than the second pressure;

determining a first contamination amount of the first fluid sample using an optical fluid analysis (OFA) sensor;

determining a second contamination amount of the second fluid sample using the OFA sensor;

determining in real-time a difference between the first and second contamination amounts;

confirming correct operation of the fluid sampling device by determining in real-time a maximum of the difference between the first and second contamination amounts;

extrapolating future values for the difference between the first and second contamination amounts by:

normalizing the first and second contamination amounts using initial values of the first and second contamination amounts determined upon commencement of withdrawing the first and second fluid samples; and fitting to a power-law model the determined difference between the first and second contamination amounts;

determining from the extrapolated future values a time at which the difference between the first and second contamination amounts will reach a minimum;

continuing withdrawing of the first and second fluid samples until reaching the determined time; and then initiating collection of a portion of the first fluid sample.

2. An apparatus, comprising:

a wellbore tool configured for conveyance in a wellbore extending into an earth formation, comprising:

a fluid sampling device comprising:

an inner probe configured to withdraw a first fluid sample from the formation; and an outer probe surrounding the inner probe and configured to withdraw a second fluid sample from the formation;

means for urging the fluid sampling device into contact with a wall of the wellbore;

means for withdrawing the first and the second fluid samples from the formation while:

maintaining the inner probe at a first pressure; and maintaining the outer probe at a second pressure, wherein the first pressure is higher than the second pressure;

means for determining a first contamination amount of the first fluid sample using an optical fluid analysis (OFA) sensor;

means for determining a second contamination amount of the second fluid sample using the OFA sensor; and means for:

determining in real-time a difference between the first and second contamination amounts;

confirming correct operation of the fluid sampling device by determining in real-time a maximum of the difference between the first and second contamination amounts;

extrapolating future values for the difference between the first and second contamination amounts by:

normalizing the first and second contamination amounts using initial values of the first and second contamination amounts determined upon commencement of withdrawing the first and second fluid samples; and fitting to a power-law model the determined difference between the first and second contamination amounts;

determining from the extrapolated future values a time at which the difference between the first and second contamination amounts will reach a minimum;

continuing withdrawing of the first and second fluid samples until reaching the determined time; and then initiating collection of a portion of the first fluid sample.

* * * * *